US005103664A

United States Patent [19]

Guidash

[11] Patent Number: 5,103,664

[45] Date of Patent: Apr. 14, 1992

[54] SELF-SEALING EXTRUSION DIE AND DIE RING AND ASSOCIATED EXTRUSION PROCESS

[75] Inventor: Julius D. Guidash, Commodore, Pa.

[73] Assignee: Season-All Industries, Inc., Indiana, Pa.

[21] Appl. No.: 640,127

[22] Filed: Jan. 11, 1991

[51] Int. Cl.[5] ..... B21C 25/02

[52] U.S. Cl. ..... 72/272; 72/467

[58] Field of Search ..... 72/271, 272, 467

[56] References Cited

U.S. PATENT DOCUMENTS

| | | | |
|---|---|---|---|
| 1,331,169 | 2/1920 | Swift et al. . | |
| 2,755,926 | 7/1956 | Horn . | |
| 2,894,623 | 7/1959 | Walton | 62/272 |
| 3,014,583 | 12/1961 | Huffman et al. . | |
| 3,113,676 | 12/1963 | Harkenrider . | |
| 3,555,874 | 1/1971 | Kuhn . | |
| 3,630,064 | 12/1971 | Mahns | 72/467 |
| 3,779,063 | 12/1973 | Gannon . | |
| 4,056,964 | 11/1977 | Shibasaki et al. | 72/272 |
| 4,425,774 | 1/1984 | Shinozaki et al. . | |

FOREIGN PATENT DOCUMENTS

| | | | |
|---|---|---|---|
| 1131174 | 6/1962 | Fed. Rep. of Germany | 72/467 |
| 2521369 | 11/1976 | Fed. Rep. of Germany | 72/467 |
| 11217 | 1/1990 | Japan | 72/272 |
| 730403 | 4/1980 | U.S.S.R. | 72/467 |

*Primary Examiner*—Lowell A. Larson
*Attorney, Agent, or Firm*—Arnold B. Silverman; David V. Radack

[57] ABSTRACT

The die and die ring and the associated extrusion process of the invention comprises providing an extrusion press including a billet container which holds a billet of material to be extruded and a die assembly which holds a die ring. The die ring is adapted to hold a die. The die ring has a first mating member and the die has a second mating member. The process further includes the step of moving the billet container into contact with the die assembly so that the die ring and die form a seal by means of the first and second mating members. The process further comprises the step of pushing the billet of material through the die assembly such that the extrusion is formed. The die assembly of the invention includes a die ring which contains a die. The die ring has a first mating member and the die has a second mating member. The die has a facing surface having a diameter less than or equal to the diameter of the billet opening of the extrusion press billet container. The die facing surface is co-planar with the entry surface of the die ring and protrudes from the exit surface of the die ring. The force of the billet container on the die assembly causes the die to seal to the die ring by means of the first and second mating members.

33 Claims, 2 Drawing Sheets

SELF-SEALING EXTRUSION DIE AND DIE RING AND ASSOCIATED EXTRUSION PROCESS

BACKGROUND OF THE INVENTION

1. Field Of The Invention

This invention relates to a self-sealing extrusion die and die ring and an associated extrusion process and more particularly to an extrusion process and die which minimizes "caving" in dies.

2. Background Information

It is well known to make extrusions using an extrusion press. A standard extrusion press is a massive device which consists of a movable billet container defining a cylindrical billet opening which receives a heated billet material to be extruded. The press further includes a die assembly, held in place by a die slide, and a platen against which the die slide and die assembly are positioned. For solid dies, the die assembly consists of a die ring which holds a die and a backer. The die contains the shape of the final extrusion. The extrusion press is equipped with a hydraulic ram which forces the material to be extruded against the die to form the extrusion.

The process of making an extrusion consists of loading a billet of material into the movable billet container, moving the billet container into contact with the die assembly and then forcing the material through a die and backer by means of the hydraulic ram to form the extrusion.

FIGS. 1 and 1A of the drawings show a crosssectional view of the prior art extrusion press. It can be seen that the billet container 10 has a billet opening 12 having a diameter "b" with a billet 14 and a dummy block **14*a* placed therein. The die assembly 15 consists of a die slide 16 which holds the bolster 17 and die ring 18. The die ring 18 contains the die backer 19 and the die 20. The die assembly 15 is supported by a platen 21 having a platen ring 22. As is well known, the platen 21 provides "back pressure" on the die assembly to counteract the force of the hydraulic ram 23 pushing the billet 14 through the die assembly 15 to form the extrusion 24**.

The die 20 has a facing surface with a diameter of "d". As can be seen, diameter "d" is larger than the billet opening 12 diameter "b". Conventionally, the die facing surface diameter "d" is 9⅜", whereas the billet opening diameter "b" is 7⅞". These diameters will vary depending on the size of the extrusion press. Also, the die is designed to protrude from the die ring at "p" about 0.020 inches.

When the billet container is moved into contact with the die assembly as shown in FIGS. 1 and 1A, the combination of the larger diameter facing surface of the die and the fact that the die protrudes from the die ring means that the billet container forms an annular seal "s" on the die facing surface. This seal is necessary so that the aluminum to be extruded does not squirt out from an opening between the container and the die face, a phenomenon known as "flairing".

A major problem with traditional dies is a phenomenon known as "caving". Caving occurs because the entire force of the billet is concentrated in the center of the die. Over time, this will cause the center to be pushed in or "caved". As can be seen with the prior art extrusion method, the entire force of the billet is upon the center of the die facing surface. As is well known in the extrusion art, a small variation in the die facing surface can lead to major distortions in the extruded product.

There is a need for an extrusion process and an associated die and die ring that minimizes the problems associated with prior art extrusion methods. This process should resist caving of the die and thus avoid the problems associated with this phenomenon. Finally, the process should be adapted to be used on standard extrusion presses.

SUMMARY OF THE INVENTION

The die and die ring and the associated extrusion process of the invention has met the above needs. The process comprises providing an extrusion press including a billet container which holds a billet of material to be extruded and a die assembly which holds a die ring. The die ring is adapted to hold a die. The die ring has a first mating member and the die has a second mating member. The process further includes the step of moving the billet container into contact with the die assembly so that the die ring and die form a seal by means of the first and second mating members. Finally, the process comprises the step of pushing the billet of material through the die assembly such that the extrusion is formed.

The die assembly of the invention includes a die ring which contains a die. The die ring has a first mating member and the die has a second mating member. The die has a facing surface having a diameter less than or equal to the diameter of the billet opening of the extrusion press billet container. The die facing surface is co-planar with the entry surface of the die ring and protrudes from the exit surface of the die ring. In this way, the force of the billet container on the die assembly causes the die to seal to the die ring by means of the first and second mating members.

It is an object of the invention to provide a process that substantially resists die caving.

It is a further object of the invention to provide a process that increases billet container life because there is no sealing of the billet container onto the facing surface of the die.

It is a further object of the invention to use a smaller die to produce the same extrusions as larger dies.

It is a further object of the invention to reduce die costs by using smaller dies.

It is a further object of the invention to minimize the necessity for die correction due to die caving.

It is a further object of the invention to provide a process that minimizes scrap caused by incorrect dies.

It is a further object of the invention to minimize the number of extrusion runs to get new dies extruding to print.

These and other objects of the invention will be fully understood from the following description of the invention with reference to the drawings appended to the application.

DESCRIPTION OF THE PREFERRED EMBODIMENTS

Figure 1:
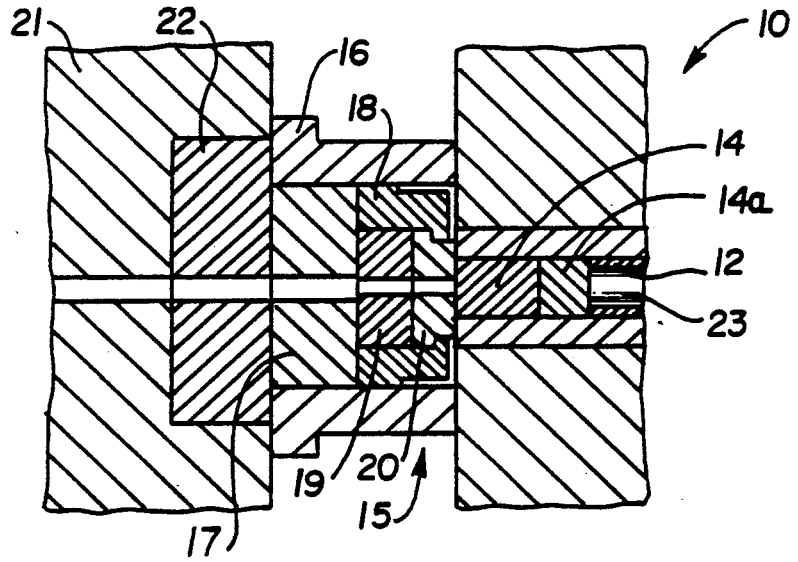
FIG. 1 (PRIOR ART)
FIG. 1 is a cross-sectional view of the extrusion press of the prior art.
Figure 1A:
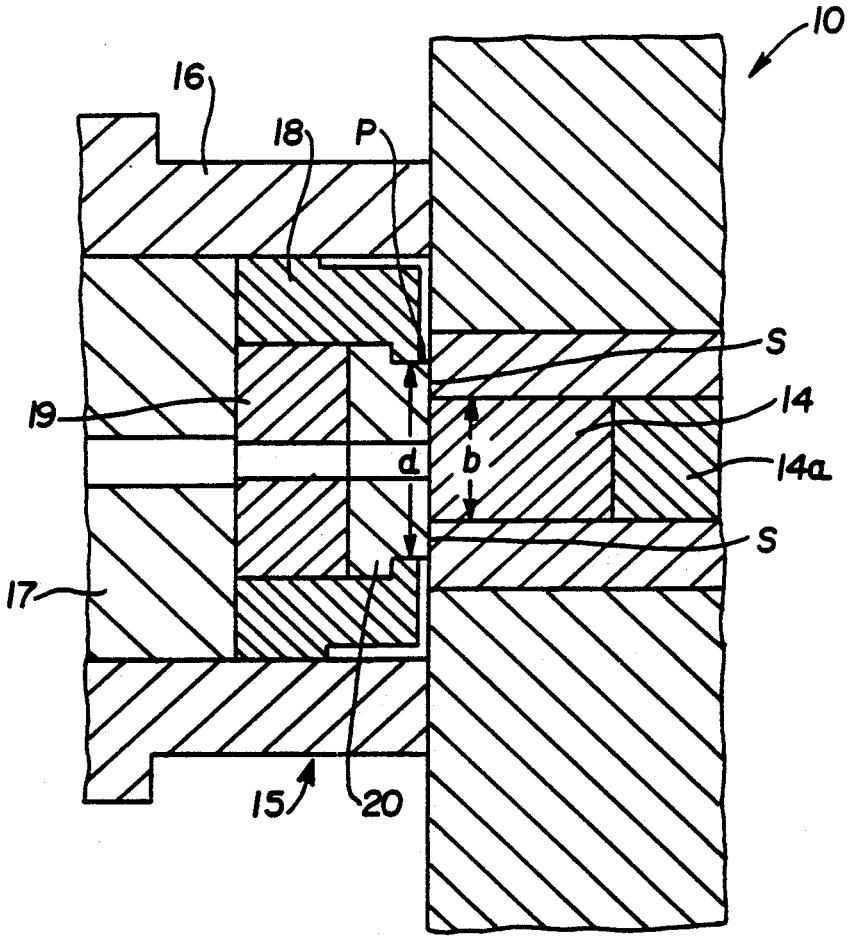
FIG. 1A (PRIOR ART)
FIG. 1A is a detailed view of a portion of FIG. 1.
Figure 2:
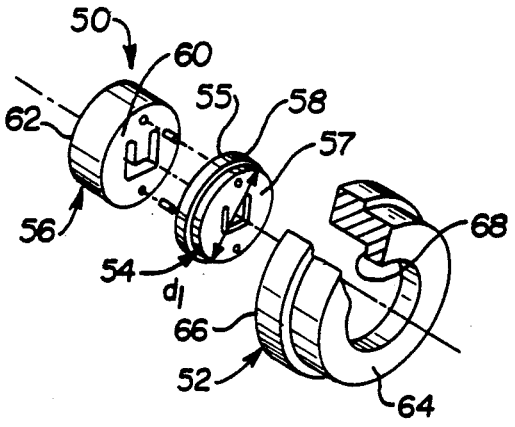
FIG. 2 is an exploded perspective view partially in section of the die assembly of the invention.

Referring to FIG. 2, the die assembly 50 of the invention is shown. The die assembly 50 consists of a die ring 52 which holds a die 54 and a die backer 56. The die 54 has a facing surface 57 having a diameter "$d_1$" and a back surface 55. The die 54 also has an annular step 58. The die backer also has a facing surface 60 and a back surface 62. The die 54 and die backer 56 are designed to be disposed inside the die ring 52. The die ring has a first or entry surface 64 and a second or exit surface 66. The die ring also has an annular lip 68 on its inner surface. The annular lip 68 and the annular step 58 of the die 54 form complementary mating members which are designed to mate when the die assembly is in use as will be explained hereinafter with respect to FIGS. 3 and 3A.

The die facing surface 57 is dimensioned so that its diameter is equal to or smaller than a billet container of the extrusion press billet container used to form the opening. The die assembly 50 is made so that the die facing surface 57 is co-planar with the first (or entry) surface of the die ring 52 and so that the die backer protrudes about 0.15 to 0.020 inches or preferably 0.020 inches from the second (or exit) surface of the die ring 66.

Figure 3:
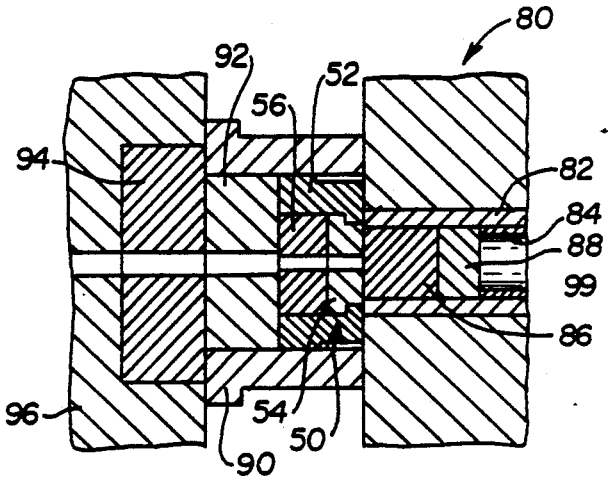
FIG. 3 is a cross-sectional view of an extrusion press used in the invention showing the die assembly of the invention.
Figure 3A:
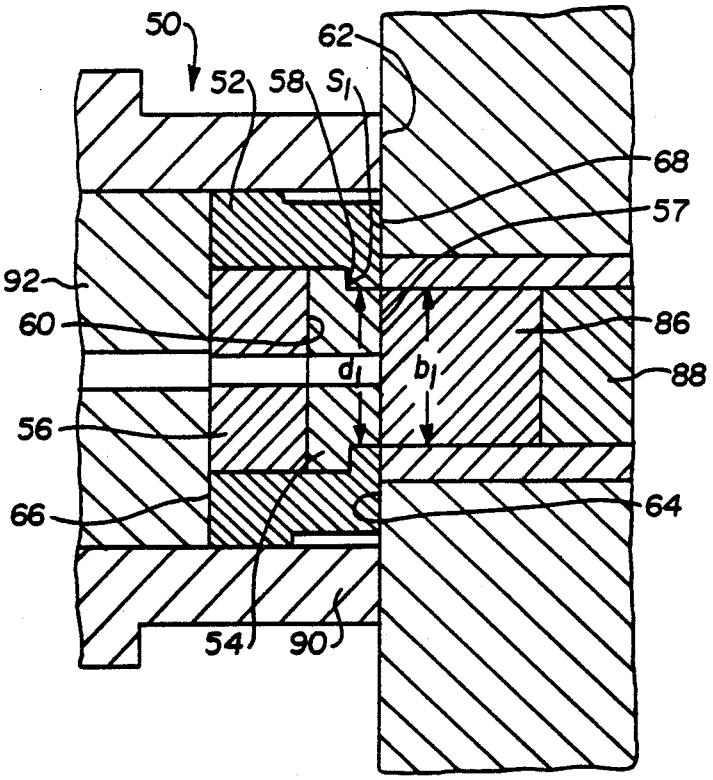
FIG. 3A is a detailed view of a portion of FIG. 3.

Referring now more particularly to FIGS. 3 and 3A, a cross-sectional view of the die assembly of the invention is shown in place in an extrusion press. The extrusion press consists of a movable billet container 80 having an annular container liner 82 which defines a cylindrical billet opening 84. The billet container 80 is movably mounted on a frame (not shown). The billet opening 84 holds the billet of material 86 to be extruded and a dummy block 88. The billet of material 86 is usually a cylindrical bar of aluminum. The billet opening 84 has a diameter of "$b_1$". The extrusion press also consists of the die assembly 50 which is held in place by a die slide 90. Positioned behind the die assembly 50 is an annular bolster 92. The bolster 92 bears against a platen ring 94 in the platen 96. As is well known, the platen 96 is connected to the frame of the billet container by tie rods (not shown).

As can be seen on FIGS. 3 and 3A, the diameter "$b_1$" of the billet container opening 84 is equal to the diameter "$d_1$" of the die facing surface 57. It will be appreciated that in accordance with the invention, the die facing diameter can also be smaller than the diameter of the billet container opening. The die facing surface 57 is also flush with the entry surface 64 of the die ring 52. Finally, the die backer 56 protrudes about 0.015 to 0.020 inches or preferably 0.020 inches from the exit surface 66 of the die ring.

In operation, the billet container is moved into contact with the die assembly 50. This will cause the die ring annular lip 68 to bear against the die annular step 58. This forms an annular seal at "$s_1$". After the seal "$s_1$" has been formed, the billet of material to be extruded is pushed against the die assembly 50 by means of an hydraulic ram 99. Back pressure to the die assembly is created by the bolster 92 and in turn the platen 96 bearing against the protruded die backer 56. This will extrude the billet through the die to form the final extruded product.

As can be appreciated, the die assembly and process of the invention will substantially reduce die caving. This is because the force of the billet is distributed substantially uniformly over the entire facing surface of the die as opposed to the prior art where the force of the billet beared against the center of the die. An additional benefit of the invention is that smaller dies can be used, thus saving on die costs.

A solid die assembly 50 was illustrated. It will be appreciated, however, that porthole dies and pancake dies can also be used in the invention. The die facing surfaces of these dies should be smaller than or equal to the size of the billet container opening of the particular extrusion die press and the die cap (for porthole dies) or die backer (for pancake dies) should protrude from the exit surface of the die ring to provide the necessary back pressure.

A die assembly and an extrusion process has been illustrated which substantially reduces die caving of extrusion dies. The die assembly can be used on standard extrusion presses. The extrusion process will produce correct extrusions without the die caving problems associated with prior art methods.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

I claim:

1. A method of making an extrusion comprising the steps of:

providing an extrusion press including (i) a movable billet container which defines a generally cylindrical billet opening for receiving a billet of material to be extruded; (ii) a die assembly; (iii) means for holding said die assembly; and (iv) stationary platen means against which said die holding means is positioned;

providing said die assembly including (i) die ring means having an entry surface and an exit surface, (ii) die means having a die facing surface and a back surface, said die means being disposed in said die ring means;

providing said die ring means having a first mating member comprising lip means on the inner surface of said die ring means and said die means having a second mating member comprising step means on the outer surface of said die means;

providing said die means facing surface equal to or smaller than the diameter of said billet container opening;

moving said billet container into contact with said die assembly so that said first mating member and said second mating member form a seal between said die ring means and said die means; and pushing said billet of material through said die assembly, whereby said extrusion is produced.

2. The method of claim 1, including providing said first mating member as an annular lip on the inner surface of said die ring means.

3. The method of claim 2, including providing said second mating member as an annular step on the outer surface of said die means.

4. The method of claim 3, including positioning said die means in said die ring such that said die means facing surface is substantially co-planar with said die ring means entry surface and such that said die means back surface protrudes from said die ring means exit surface.

5. The method of claim 4, including
said die means back surface protruding about 0.015 to 0.020 inches from said die ring means exit surface.

6. The method of claim 1, including
providing said die assembly being a solid die assembly.

7. The method of claim 1, including
providing said die assembly being a porthole die assembly.

8. The method of claim 1, including
providing said die assembly being a pancake die assembly.

9. The method of claim 1, including
providing said seal between said die ring means and said die means being oriented generally perpendicular to the direction of movement of said billet of material to be extruded.

10. A die assembly adapted for use in an extrusion apparatus, said extrusion apparatus including a movable billet container which defines a cylindrical billet opening for receiving a billet of material to be extruded, means for holding said die assembly, stationary platen means against which said die holding means is positioned and means for forcing said billet of material through said billet opening and into contact with said die assembly, said die assembly comprising:
die ring means having an entry surface and an exit surface; and
die means having a facing surface and a back surface;
said die means being disposed in said die ring means;
said die ring means having a first mating member comprising lip means on the inner surface of said die ring means;
said die means having a second mating member comprising step means on the outer surface of said die means; and
said die means facing surface having a diameter less than or equal to the diameter of said billet container opening, whereby when said billet container contacts said die assembly, said first and second mating members form a seal between said die ring means and said die means.

11. The die assembly of claim 10, wherein
said die means facing surface being substantially coplanar with said die ring means entry surface.

12. This die assembly of claim 11, wherein
said die means back surface protruding from said die ring means exit surface.

13. The die assembly of claim 12, wherein
said first mating member is an annular step.

14. The assembly of claim 13, wherein
said second mating member is an annular lip.

15. The die assembly of claim 14, wherein
said die means is a solid die.

16. The die assembly of claim 15, wherein
said solid die includes a die and die backer.

17. The die assembly of claim 12, wherein
said die means back surface protrudes about 0.015 to 0.020 inches from said die ring second surface.

18. The die assembly of claim 17, wherein said die means back surface protrudes about 0.020 inches from said die ring second surface.

19. The die assembly of claim 10, wherein
said die means is a porthole die.

20. The die assembly of claim 10, wherein
said die means is a pancake die.

21. The die assembly of claim 10, wherein
said seal between said die ring means and said die means is oriented generally perpendicular to the direction of movement of said billet of material to be extruded.

22. An extrusion press apparatus comprising:
a movable billet container which defines a cylindrical billet opening for receiving a billet of material to be extruded;
a die assembly including (i) die ring means having an entry surface and an exit surface, (ii) die means having a facing surface and backing surface;
said die means being disposed in said die ring means;
said die ring means having a first mating member comprising lip means on the inner surface of said die ring means;
said die means having a second mating member comprising step means on the outer surface of said die means;
means for holding said die assembly;
stationary platen means against which said die holding means is positioned; and
means for forcing said billet of material through said billet opening and into contact with said die assembly;
said die means facing surface having a diameter less than or equal to the diameter of said billet container opening, whereby when said billet container contacts said die assembly, said first and second mating members form a seal between said die ring means and said die means.

23. The apparatus of claim 22, wherein
said die means facing surface being substantially coplanar with said die ring means entry surface.

24. The apparatus of claim 23, wherein
said die means back surface protruding from said die ring means exit surface.

25. The apparatus of claim 24, wherein
said first mating member is an annular step.

26. The apparatus of claim 25, wherein
said second mating member is an annular lip.

27. The apparatus of claim 26, wherein
said die means is a solid die.

28. The apparatus of claim 27, wherein
said solid die includes a die and die backer.

29. The apparatus of claim 24, wherein
said die means back surface protrudes about 0.015 to 0.020 inches from said die ring second surface.

30. The apparatus of claim 29, wherein said die means back surface protrudes about 0.020 inches from said die ring second surface.

31. The apparatus of claim 22, wherein
said die means is a porthole die.

32. The apparatus of claim 22, wherein
said die means is a pancake die.

33. The apparatus of claim 22, wherein
said seal between said die ring means and said die means is oriented generally perpendicular to the direction of movement of said billet of material to be extruded.

* * * * *